US005931076A

United States Patent [19]

Ryan

[11] Patent Number: 5,931,076

[45] Date of Patent: Aug. 3, 1999

[54] ROPE CONSTRUCTION

[75] Inventor: Richard J. Ryan, Anacortes, Wash.

[73] Assignee: Puget Sound Rope Corporation, Anacortes, Wash.

[21] Appl. No.: 09/119,384

[22] Filed: Jul. 20, 1998

Related U.S. Application Data

[63] Continuation-in-part of application No. 08/871,613, Jun. 10, 1997.

[51] Int. Cl.[6] ..... D04C 1/12

[52] U.S. Cl. ..... 87/8; 87/13

[58] Field of Search ..... 87/3, 5, 7, 8, 13, 87/6

[56] References Cited

U.S. PATENT DOCUMENTS

| | | | |
|---|---|---|---|
| 346,577 | 8/1886 | Briggs | 87/6 |
| 2,177,777 | 10/1939 | Madden et al. | 96/25 |
| 3,090,277 | 5/1959 | Schmittmann | 87/6 |
| 3,335,634 | 8/1967 | Betta | 87/8 |
| 3,358,434 | 12/1967 | McCann | 87/6 |
| 3,805,667 | 4/1974 | Orser | 87/6 |
| 4,170,921 | 10/1979 | Repass | 87/6 |
| 5,059,213 | 10/1991 | Chesterfield et al. | 606/228 |
| 5,662,682 | 9/1997 | Chesterfield et al. | 606/228 |

FOREIGN PATENT DOCUMENTS

| | | | |
|---|---|---|---|
| 1248116 | 10/1959 | France | 87/6 |
| 19907 | 9/1904 | United Kingdom | 87/6 |

OTHER PUBLICATIONS

The Modern Textile Dictionary, Meredith Press, p. 289, 1963.

*Primary Examiner*—John J. Calvert
*Assistant Examiner*—Tejash D. Patel
*Attorney, Agent, or Firm*—Todd N. Hathaway

[57] ABSTRACT

A method for construction of a large diameter braided rope. The rope is formed of high strength, low elongation synthetic fibers which are twisted together at a twist factor in the range from about 125 to about 145 to form a plurality of comparatively small diameter yarns. The small diameter twisted yarns are then braided together at a pick multiplier in the range from about 1.0 to about 2.0 so as to form a plurality of braided strands, and the strands, in turn, are braided together with a pick multiplier of about 2.0–3.6 so as to form the large diameter braided rope. The braiding of the strands imparts a degree of coherence which permits a lower twist factor to be used in the yarns. This results in a significant increase in translational efficiency over conventional twisted-strand construction, by avoiding the over twisting of low elongation fibers which occurs when forming large diameter yarns.

24 Claims, 4 Drawing Sheets

ROPE CONSTRUCTION

RELATED APPLICATIONS

This application is a continuation-in-part of U.S. Ser. No. 08/871,613, filed Jun. 10, 1997, entitled "Rope Construction".

FIELD OF THE INVENTION

The present invention relates generally to the construction of ropes, and, more particularly to a braided construction which is particularly suited to large diameter ropes made of low-elongation artificial fiber materials.

BACKGROUND

Conventional braided construction is widely used in the manufacture of ropes for various uses. In conventional braiding, twisted yarns are woven under and over each other repeatedly, so that each yarn follows a generally helical path over the full length of the rope. The angle of the path depends on the tightness of the braid, commonly expressed in terms of a number of "picks" per unit length, with term "pick multiplier" representing the number of picks per inch of the rope times its circumference.

The individual yarns are twisted prior to braiding, primarily because this is necessary in order to form the fibers into a coherent bundle. The term "twist factor" as used herein represents the number of turns of the twist per inch (referred to as "TPI") times the square foot of the yarn denier, the yarn denier being calculated by the denier of the fibers multiplied by the number of fibers in the yarn. The twisting also serves to increase the translational efficiency of the yarns slightly (as used herein, the term "translation efficiency" expresses the relationship between the breaking strength of the yarn and the combined breaking strength of the fibers which form the yarn, in terms of a percentage of the latter value), by helping to ensure that the individual fibers are more evenly loaded. However, while a small amount of twist (e.g., ½ turn per inch for a ⅜" diameter bundle) will produce a slight increase in translational efficiency (perhaps 10%, for example), twisting the yarn any further causes a rapid decline in tensile strength. This is because with further twisting the fibers on the outside of the bundle begin to follow significantly longer paths than those towards the inside, so that in use the shorter fibers become overloaded before they can elongate sufficiently for the longer fibers to begin taking a strain; this is a particular problem when working with modern low-elongation fiber materials, some of which are able to stretch only about 2–4% before breaking.

Although the industry has for many years constructed braided ropes using twisted yarns, this conventional technique has come to exhibit several serious deficiencies drawbacks in connection with recent advances in rope size and fiber technology. For example, there is an increasing need for very large diameter braided ropes (e.g., for use on large escort tugboats, in single point mooring systems, in the offshore oil industry, and so on), but because of existing equipment and other reasons most braided rope is limited to using a certain, relatively low number of strands (e.g., 12-strand braided rope, 8-strand braided rope, etc.). Consequently, since the number of strands must remain the same, to making larger diameter ropes the conventional approach has been to simply increase the diameter of the twisted yarns which form the strands. The approach of simply "scaling up" the yarns has not proven very successful, however, especially when using comparatively new, low-elongation fiber materials. This is in part because the formation of large diameter yarns requires multiple stage twisting when working with synthetic fiber materials (because synthetic fiber materials have very smooth, slippery surface textures, as compared with rougher-surfaced natural fibers, which tend to form a firm bundle upon initial twisting. When performing multiple-stage twisting, however, it is virtually impossible to give the yarn a satisfactory degree of coherency without exceeding the optimal amount of twist, especially when working with low-elongation fibers, with the result that translational efficiency suffers severely. While using a very loose twist would avoid loss of translational efficiency, this would result in an unacceptably low level of coherency, and would produce a loose, "sleazy" yarn which would be prone to snag damage and otherwise be unsuitable for commercial service. In short, when using low-elongation fiber materials in large-diameter twisted yarns, it is difficult or impossible to achieve both an acceptable degree of coherency and a high level of translation efficiency.

Processes exist by which twisted UHMWPE and other yarns can be successfully stretched at elevated temperatures to achieve a high degree of translational efficiency without damaging the individual fibers. Even these processes, however, have a practical upper limit in terms of the diameter of yarn which can be treated successfully in a production operation, and for the present this limit is well below the diameter of the yarns which are necessary for the construction of very large braided ropes using conventional techniques.

Another problem with conventional braided construction stems from the need to splice the yarns multiple times when braiding long pieces of rope. To illustrate this, reference is made to FIG. 5, which shows a conventional braider machine 01 having a plurality of bobbins 02 mounted on a table 03 for developing an intertwining rotation (note: since the braider machine does not itself constitute a part of the present invention and is well known to those skilled in the relevant art, only an overview of the mechanism will be provided here). As the bobbins move about, the yarns are woven over and under one another and drawn upwardly through a collar 05 by a take-up reel 07. Then, as each bobbin runs out of yarn, it is necessary to stop the machine and splice in the yarn from a fresh bobbin. It is not generally practical to splice the ends of twisted yarns together (since they tend to simply unravel into an incoherent mass), and so the conventional practice has been to place the fresh bobbin in an open area 08 at the center of the table and then lead the end of the yarn upwardly into the core of the rope, as indicated by arrow 09. The machine is run to form another 20–30 feet (typically) of rope, and then the yarn from the old bobbin is cut off and the new bobbin is mounted in its place at the edge of the table.

This technique is conventionally referred to as a "braider interchange," and although used for many years, it is unsatisfactory in many respects. Firstly, because this is a frictional splice it will always represent a weak spot in the rope. Also, the 20–30 ft overlap represents a costly wastage of material, especially when using expensive fibers. Still further, this type of splice becomes extremely difficult to perform when braiding large diameter ropes. This is because the spools which are needed to carry the larger-diameter twisted yarns are much bigger and more tightly packed on the table of the braider machine than is shown in FIG. 5, with the result that there is simply no space in the middle of the table in which to position the replacement spool (scaling up the size of the machines to provide more room is greatly too expensive to be a practical option). Moreover, when the twisted yarns are very large it becomes difficult to handle the heavy, stiff end of the yarn and feed it up into the core of the rope.

The use of large twisted yarns to form the strands of the rope also makes it very difficult to make repairs to conventional braided ropes when individual strands become damaged in service. For example, a single yarn may become snagged, cut, or otherwise damaged while the remainder of the rope remains intact. The inability to repair the individual yarns, however, means that an entire length of the rope must be discarded, at great cost.

Accordingly, there exists a need for a method of constructing large diameter braided ropes wherein a high degree of translational efficiency is achieved, especially when using low-elongation fiber materials. Furthermore, there exists a need for such a method of construction which allows large-diameter braided rope to be manufactured without having to use excessively large twisted yarns. Still further, there exists a need for such a method of construction which permits faster, more efficient splices to be formed between the ends of individual strands during the construction of the rope. Still further, there is a need for such a method for constructing braided ropes which permits individual strands to be spliced so as to repair damage without having to discard an entire length of the rope.

SUMMARY OF THE INVENTION

The present invention has solved the problems cited above, and provides a method of constructing braided rope. The method comprises the steps of: (a) twisting a multiplicity of low elongation fibers together at a twist factor in the range from about 125 to about 145 so as to form a plurality of twisted yarns; (b) braiding a plurality of the twisted yarns together in a primary braid at a pick multiplier in the range from about 1.0 to about 2.0 so as to form a plurality of braided strands; and (c) braiding a plurality of the braided strands together in a secondary braid at a pick multiplier from about 2.0 to about 3.6 so as to form the large diameter braided rope.

The step of braiding the yarns together may comprise braiding the twisted yarns together so as to form a plurality of braided strands having a diameter of about 7/16 inch or greater. The step of braiding the strands together may comprise braiding the plurality of braided strands together so as to form a rope having a circumference of about 5 inches or greater.

The pick multiplier of the primary braid may preferably be in the range from about 1.0 to about 1.4, and that of the secondary braid may preferably be in the range from about 2.0 to about 2.8.

In a preferred embodiment, the step of braiding the plurality of yarns together may comprise twisting the multiplicity of the fibers together at a twist factor in a range from about 134 to about 140. The twisted yarns may be braided together in a primary braid having a pick multiplier in the range from about 1.3 to about 1.4, and then be braided together in a secondary braid having a pick multiplier in the range from about 2.6 to about 2.8.

The present invention also provides a large diameter, braided rope, comprising a multiplicity of low elongation fibers twisted together at a twist factor in the range from about 125 to about 145, so as to form a plurality of twisted yarns, a plurality of the twisted yarns being braided together in a primary braid at a pick multiplier in the range from about 1.0 to about 2.0, so as to form a plurality of braided strands, and a plurality of the braided strands being braided together in a secondary braid at a pick multiplier in a range from about 2.0 to 3.6 so as to form the large diameter rope.

DETAILED DESCRIPTION

The present invention provides a form of rope construction which is especially suited to the manufacture of large-diameter braided rope in comparatively long lengths. Moreover, the form of construction provided by the present invention is particularly advantageous when working with very low-elongation fiber materials, i.e., fibers which are capable of elongating no more than about 7% before breakage. Examples of such fiber materials include high-modulus low-elongation polyester, Kevlar™ (available from E.I. DuPont de Nemours & Co., Wilmington, Del., U.S.A.), liquid crystal fiber materials such as Vectron™ (available from Celanese Corporation, New York, N.Y., U.S.A.), and UHMWPE fiber materials such as Spectra™ (available from Allied Signal, Inc., Morristown, N.J., U.S.A.) and Dyneema™ (available from DSM Fibers, B.V., Heerlen, Netherlands).

In the present invention, the rope is formed by the braiding of strands which themselves have been braided, as opposed to braiding large-diameter twisted yarns as in conventional practice. The present invention thus allows the rope to use twisted yarns which have a much smaller diameter than would otherwise be required, which in turn reduces or eliminates the need for multiple-stage twisting of the yarns. Moreover, for even very large sizes of rope this permits the use of yarn bundles having sufficiently small diameters that they can be treated using known heat stretch processes to achieve a high degree of translational efficiency. Still further, by making use of braided strands to construct the large-diameter braided rope, the present invention enables the ends of individual strands to be connected using strong, quick braided rope splices, in place of the wasteful and inefficient braider interchange described above, and also makes it possible to repair individual strands which become damaged in use.

Figure 1:
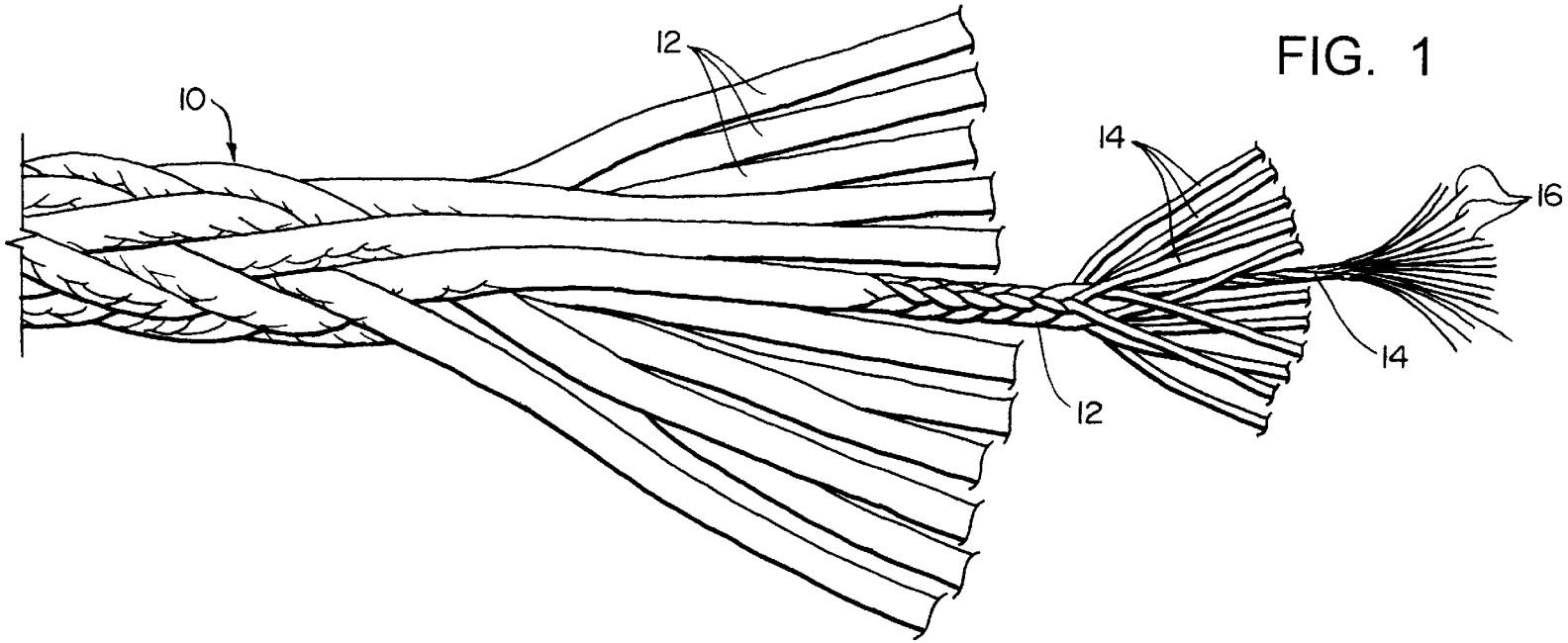
FIG. 1 is an elevational view of an end portion of a braided rope constructed in accordance with the present invention, showing schematically the manner in which small-diameter twisted yarns are braided together to form braided strands which are then braided together to form the rope itself.
Figure 2:
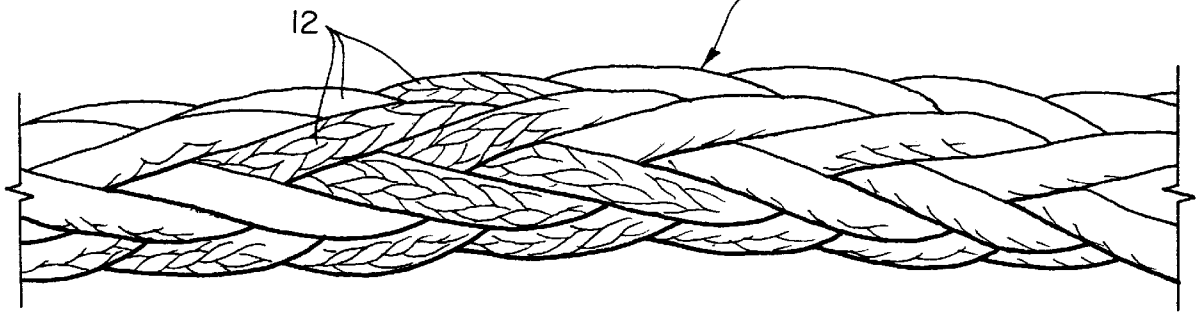
FIG. 2 is an elevational view of a length of the braided rope of FIG. 1.
Figure 3:
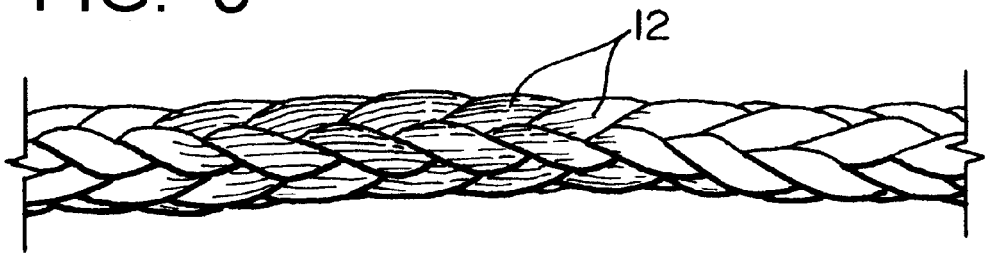
FIG. 3 is an elevational view of a single one of the braided strands which are braided together to form the rope of FIG. 2.
Figure 4:
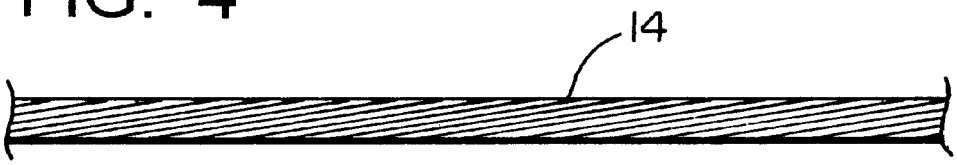
FIG. 4 is an elevational view of an individual one of the comparatively small-diameter twisted yarns which are braided together to form the braided yarns as shown in FIG. 3.

Accordingly, FIG. 1 shows a large-diameter braided rope 10 which is constructed of a plurality of individual strands 12, each of which itself is a braided member. The particular embodiment which is illustrated employs a 12-strand, two-over/two-under form of braid, but it will be understood that the present invention may be used with other forms of braid and other numbers of strands (such as 8-strand construction, for example). As can be seen in FIG. 1, each of the braided strands is in turn woven from twelve twisted yarns 14 (although, again, the actual number may vary as a matter of design choice), each of which in turn is formed of a multiplicity of individual fibers 16 which have been twisted together to form a coherent bundle. The result, as can be seen in FIG. 2, is a braided rope 10 in which each of the strands 12 is itself similar in form to a braided rope.

Figure 5:
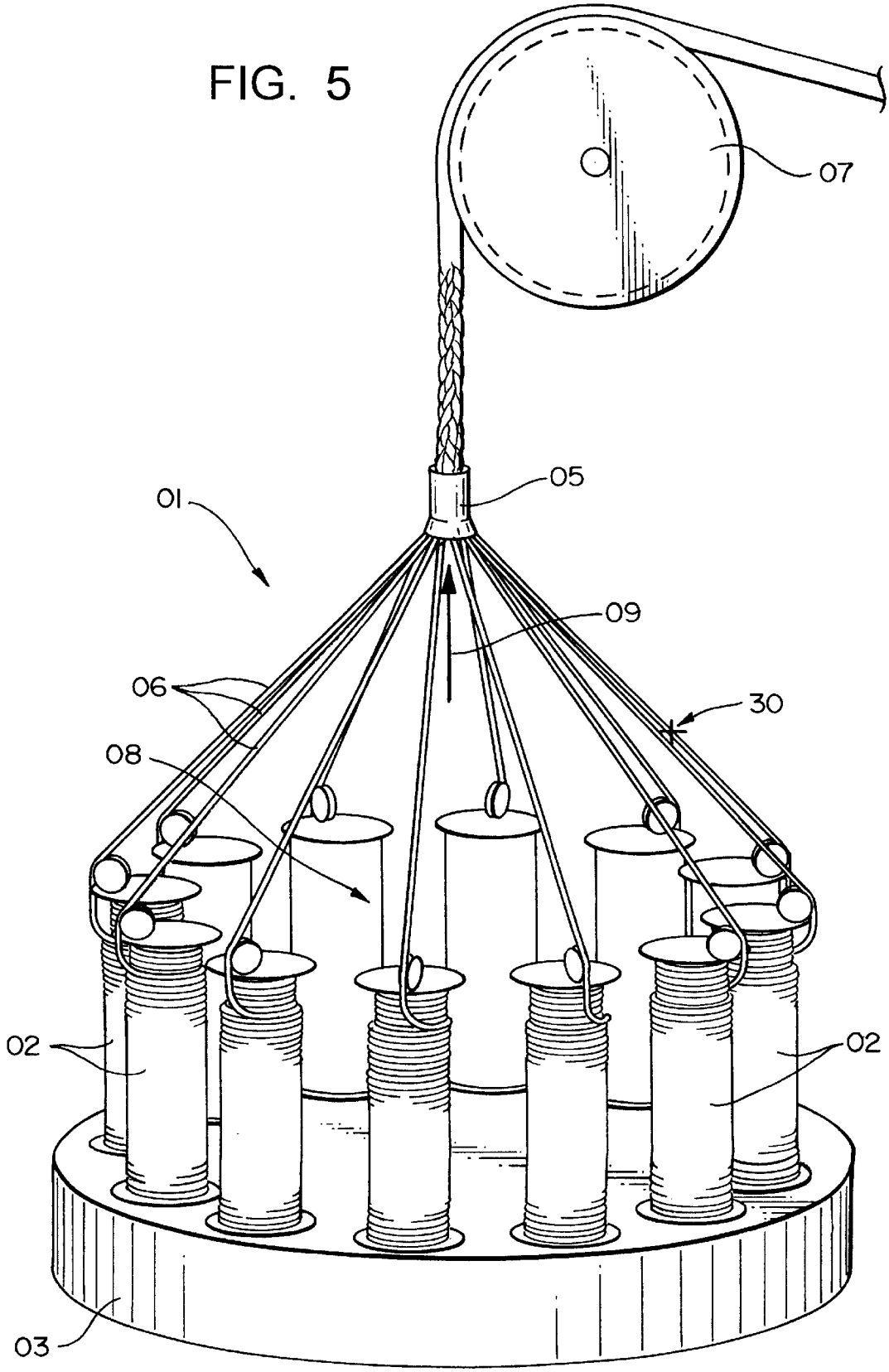
FIG. 5 is a perspective view of an exemplary braider machine for use in constructing braided rope in accordance with the method of the present invention.

Hence, to construct the rope 10, the individual twisted yarns 14 are first twisted from the fibers 16 and then braided together using a braider machine, such the twelve-strand braider shown in FIG. 5. The braided strands 12 which this produces are then wound onto second spools and loaded onto another braider machine, by which they are woven together to form the finished rope.

Because the yarns 14 are first braided into strands before being woven into the rope itself, the yarn can have a diameter which is much smaller than that which would be required if the twisted yarns were to be woven directly into the main rope, as is done in conventional construction. For example, for a twelve-strand rope constructed of twelve-yarn strands as is shown in FIG. 1, each of the yarns will have a cross-sectional area of only about 1/144th the total cross-sectional area of the rope. As a result, even for a large diameter braided rope, the diameter of the individual yarns is kept down to a comparatively small size (e.g., a 3-inch diameter rope can be made using yarns only 3/8 inch in diameter). By thus using small-diameter yarns to construct a large-diameter rope, the present invention reduces or eliminates the need for multi-stage twisting of the yarns, thereby avoiding the over-twisting problem described above. Also, since the braiding itself imparts cohesion to the strands, thereby reducing the reliance on the twist factor to give the rope the necessary firmness, the large-diameter construction described above permits such ropes to be constructed using twist factors and pick multipliers which are significantly lower than those required in conventional forms of construction.

Still further, because the braiding process itself imparts a very little additional twist to the strands, the present invention makes it possible to maintain an optimal degree of twist in the yarns so as to achieve maximum translational efficiency in the finished rope.

For example, the yarns can be given the optimal degree of twist initially, and this twist will remain largely unaffected by the subsequent braiding steps, or in some cases the yarns may be given an initial degree of twist which is just slightly less than optimum, to compensate for a small but predetermined amount of twist which will be added during the braiding process.

As a result, the braided strand construction of the present invention is able to produce a firm, cohesive rope using pick multipliers and twist factors which are much lower than those necessary in conventional twisted strand construction, thereby yielding a very significant increase in overall tensile strength when working with high-strength, low-elongation fiber materials By way of background, double-braided nylon and polyester ropes having conventional twisted strand construction typically have a twist factor of about 150 and a pick multiplier in the range from about 8.0 to 9.0. In some instances, conventional 12-strand double braided polyester rope may have a pick multiplier down in the range of about 3.4 to 4.0, but this is still relatively high in comparison with the present invention. The comparatively high twist factors and pick multipliers are necessary when using conventional twisted strand construction, in order to give the rope an acceptable degree of cohesion and durability, but for the reasons described above the higher twist factor and pick multiplier values also cause an increased loss in strength.

Using the construction of the present invention, however, it has been found that a rope which is sufficiently firm and durable for commercial service can be constructed using a twist factor in the range from about 125 to about 145, a pick multiplier in the primary braid in range from about 1.0 to about 2.0, and a pick multiplier in the secondary braid in the range from about 2.0 to about 3.6, well below the corresponding figures necessary when using traditional forms of construction. Since some loss of strength occurs if the pick multiplier exceeds 3.0, the pick multiplier of the secondary braid is preferably in the range from about 2.0 to about 3.0.

Within the above ranges, a construction using a twist factor in the range from about 130 to about 140, a primary braid pick multiplier in the range from about 1.0 to about 1.4, and a secondary braid pick multiplier in the range from about 2.0 to about 2.8 is generally preferred for the majority of applications. In particular, a rope constructed of UHMWPE fiber material and having a twist factor of about 140, a primary braid pick multiplier of about 1.35 and a secondary braid pick multiplier of about 2.7 has been found to provide an outstanding combination of strength and handling/durability qualities for general use, such as for marine tow ropes. For some specific applications, however, a somewhat looser or tighter construction may be used; for example, for some offshore platform mooring lines and other low-abrasion applications, a twist factor of about 135, a primary braid pick multiplier of about 1.2, and a secondary braid pick multiplier of about 2.4 may be used to form a rope having somewhat higher tensile strength, at the cost of a slightly looser, less abrasion resistant "body". Moreover, the primary braid (i.e., the braided yarns) can be made adequately tight to form strands which are sufficiently coherent for the intended use, and then the final braid can be made somewhat loose without impairing the overall serviceability of the rope.

The circumference of the finished rope preferably ranges from about five inches and up, with an approximate 18–20 inch circumference being in some respects a practical maximum given the limitations of existing types of braiding equipment. Below a 5 inch circumference, in turn, the increased strength advantage tends to disappear due to inherent increases in the braid path angle and the twisting of the braid.

Using pick multiplier and twist factor values within the ranges given above, the present invention produces a rope having a total amount of twist which is approximately 10–15% less than that which is required when using conventional twisted strand construction. When working with UHMWPE and other high-strength, low-elongation fiber materials, this lesser amount of twist has been found to yield an increase in total tensile strength on the order of to 40–50 percent or more over twisted-strand ropes having the same size and degree of body and coherence. Moreover, the increases in strength are achieved without requiring heat stretching of the yarns or strands.

For example, a non-heat, stretched 12-strand primary and secondary braid rope constructed of Spectra™ UHMWPE fiber in accordance with the present invention, with a twist factor of about 140, a primary, braid pick multiplier of 1.35, and a secondary braid pick multiplier of 2.7, was tested as having a breaking strength of about 883,000 pounds. A comparable but slightly larger Spectra™ UHMWPE rope having conventional, twisted bundle construction tested having a breaking strength of about 620,000. This translates to a strength increase of more than 42 percent (in fact closer to 50 percent when the size differential between the ropes is taken into account).

It is possible that the construction described above may also be of some benefit to ropes formed of lower-strength, higher-elongation materials such as nylon and polyester. It will be understood, however, that the basic problem of uneven fiber loading and breakage due to excessive twisting generally does not exist in the case of high elongation materials (because they stretch out to equalize the load between shorter and longer fibers before breaking), and so the strength increase provided by the present invention would be much less pronounced when working with such fibers.

Figure 6A:
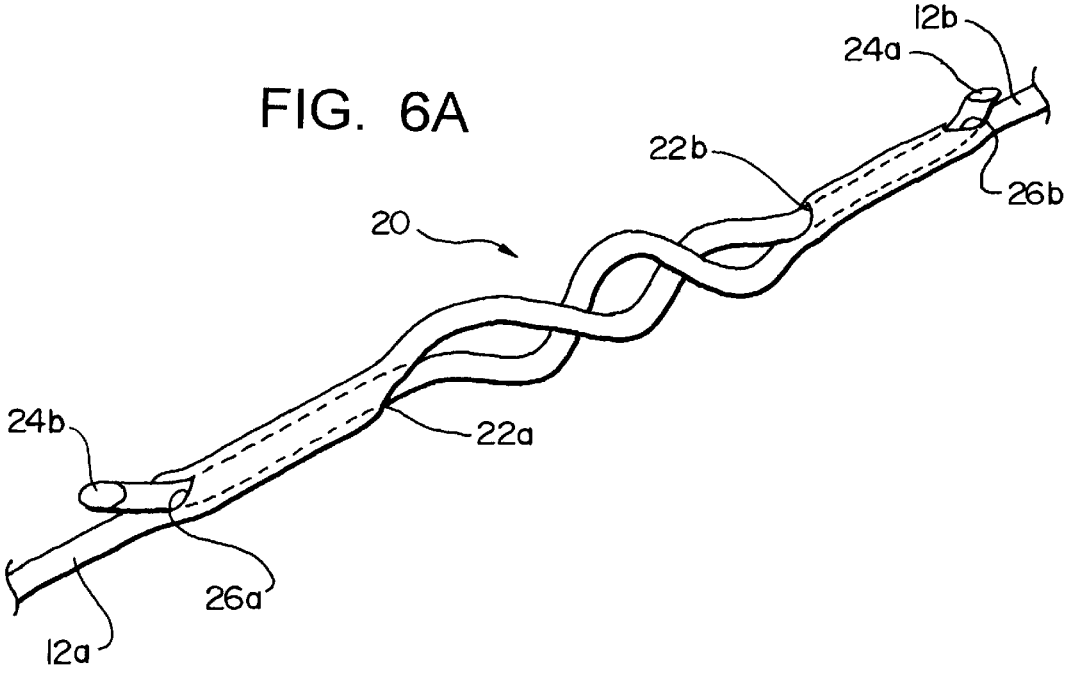
FIG. 6A is a perspective view of the manner in which an exemplary type or braided rope splice can be used to connect the individual braided strands in a rope constructed in accordance with the present invention, either during the initial manufacture thereof or to repair damage suffered in use.
Figure 6B:
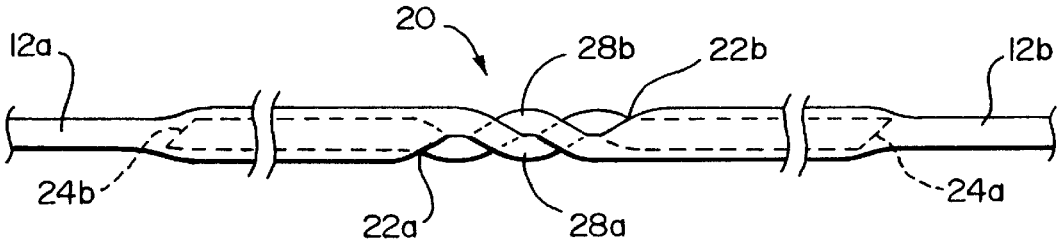
FIG. 6B is an elevational view showing the completed splice of FIG. 6A.

Yet another advantage of the present invention is that the braided structure of the strands 12 permit these to be spliced "in-line" on an individual basis by means of a quick, efficient, and very strong braided rope splice. As is used in this specification and the appended claims, the term "braided rope splice" includes all of those various types of splices which are known to those skilled in the relevant art for connecting two segments of braided rope in a more or less end-to-end relationship (as opposed to eye splices, for example). For example, FIGS. 6A–6B show first and second braided yarns 12 which are joined by means of a Chinese finger splice 20, which is one form of braided rope splice. This particular type of splice is made by spreading the braid apart using a fist or similar tool, to form openings 22*a,* 22*b* through which the overlapping ends 24*a,* 24*b* of the members are passed. Each end piece is drawn a short distance through the core of the other member, and then out through exit openings 26*a,* 26*b* which are also formed by spreading apart the braid. The two members 12*a,* 12*b* are pulled taught to tighten the intertwined middle segments 28*a,* 28 and then milked to draw the cut ends 24*a,* 24*b* back into the core, thereby completing the splice as shown in FIG. 6B. Not only is this type of splice quick and easy to make, it is extremely strong and requires little overlap (e.g., 3–4") between the two members and therefore wastes little material.

The ability to thus splice the individual strands makes it possible to eliminate the braider interchange technique which has previously been used in the manufacture of braided rope. When using braided strands in accordance with the present invention, when a bobbin is about to run empty the braider machine can simply be stopped momentarily, the end of the strand on the old bobbin can be spliced (e.g., at the point indicated at 30 in FIG. 5) to that on a fresh one, and then the new bobbin can be placed in position and the machine restarted. In addition to eliminating the weak and wasteful traditional braider interchange, the strand splice used in the present invention is also much easier and faster to perform, and obviates the problem of trying to fit the bobbin into the middle of the braider table when using large-diameter strands.

Moreover, the ability to splice the individual braided yarns permits cuts, frays, and other damage which occurs in service to be repaired using readily available tools and skills. The capability to thus repair multi-thousand dollar ropes which would otherwise have to be discarded represents a tremendous savings to the customers.

Although the present invention has been described herein with reference to an exemplary embodiment in which there are two braiding steps, it will be understood that in some embodiments there may be additional braiding steps, depending on the ultimate size of the rope, the type of material used, and other design considerations; for example, in some embodiments the small-diameter yarns may be braided together to form primary strands, which are then braided into secondary strands before being braided together to form the rope. It is therefore to be recognized that these and various other alterations, modifications, and/or additions may be introduced into the constructions and arrangements of parts described above without departing from the spirit or ambit of the present invention as defined by the appended claims.

What is claimed is:

1. A method of construction a large-diameter braided rope, said method comprising the steps of:

twisting a multiplicity of low-elongation fibers together at a twist factor in the range from about 125 to about 145, so as to form a plurality of twisted yarns;

braiding a plurality of said twisted yarns together at a pick multiplier in the range from about 1.0 to about 2.0 so as to form a plurality of braided strands; and braiding a plurality of said braided strands together at a pick multiplier in the range from about 2.0 to about 3.6 so as to form said large-diameter braided rope.

2. The method of claim 1, wherein the step of braiding said plurality of twisted yarns together comprises:

braiding said twisted yarns together at a pick multiplier in the range from about 1.0 to about 1.4 so as to form said braided strands.

3. The method of claim 2, wherein the steps of braiding said plurality of twisted yarns together comprises:

braiding said twisted yarns together at a pick multiplier of about 1.35.

4. The method of claim 1, wherein the step of braiding said plurality of braided strands together comprises:

braiding said braided strands together at a pick multiplier in the range from about 2.0 to about 2.8 so as to form said braided rope.

5. The method of claim 4, wherein the step of braiding said plurality of braided strands together comprises:

braiding said braided strands together at a pick multiplier of about 2.7.

6. The method of claim 1, wherein the step of braiding said yarns together comprises:

braiding said twisted yarns together so as to form a plurality of braided stands having a diameter of about 7/16 inch or greater.

7. The method of claim 1, wherein the step of braining said strands together comprises:

braiding said plurality of braided strands together so as to form a rope having a circumference of about 5 inches or greater.

8. The method of claim 1, wherein the step of braining said plurality of strands together comprises:

braiding said plurality of braided strands together so as to form a rope having circumference in the range from about 5 inches to about 20 inches.

9. The method of claim 8, wherein the step of braiding said plurality of yarns together comprises:

twisting said multiplicity of fibers together at a twist factor in the range from about 134 to about 140.

10. The method of claim 8, wherein:

the step of twisting said multiplicity of fibers together comprises twisting said fibers together at a twist factor of about 140;

the step of braiding said plurality of twisted yarns together comprises braiding said yarns together at pick multiplier of about 1.35; and the step of braiding said braided strands together comprises braiding said strands together at a pick multiplier of about 2.7;

so as to provide said large-diameter rope with a firmness suitable for towing use.

11. The method of claim 8, wherein:

the step of twisting said multiplicity of fibers together comprises twisting said fibers together at a twist factor of about 135;

the step of braiding said plurality of twisted yarns together comprises braiding said yarns together at a pick multiplier of about 1.2; and the step of braiding said plurality of braided strands together comprises braiding said strands together at a pick multiplier of about 2.4;

so as to provide said large-diameter rope with a firmness suitable for mooring use.

12. A method of constructing a large-diameter braided rope, said method comprising the steps of:

twisting a multiplicity of low-elongation fibers together at a twist factor in the range from about 134 to about 140 so as to form a plurality of twisted yarns;

braiding a plurality of said twisted yarns together at a pick multiplier in the range from about 1.0 to about 1.4 so as to form a plurality of braided strands having a diameter of about 7/16 inch or greater; and braiding a plurality of said braided strands together at a pick multiplier in the range from about 2.0 to about 2.8 so as to form a rope having a circumference in the range from about 5 inches to about 20 inches.

13. A large-diameter braided rope, comprising:

a multiplicity of low-elongation fibers twisted together at a twist factor in the range from about 125 to about 145, so as to form a plurality of twisted yarns;

a plurality of said twisted yarns being braided together at a pick multiplier in the range from about 1.0 to about 2.0 so as to form a plurality of braided strands, and a plurality of said braided strands being braided together of a pick multiplier in the range from about 2.0 to about 3.6 so as to form said large-diameter braided rope.

14. The braided rope of claim 13, wherein sad plurality of twisted yarns are braided together at a pick multiplier in the range from about 1.0 to about 1.4 so as to form said braided strands.

15. The braided rope of claim 14, wherein said plurality of twisted yarns are braided together at a pick multiplier of about 1.35.

16. The braided rope of claim 13, wherein said plurality of braided strands are braided together at a pick multiplier in the range from about 2.0 to about 2.8 so as to form said braided rope.

17. The method of claim 16, wherein a said plurality of braided strands are braided together at a pick multiplier of about 2.7.

18. The braided rope of claim 13, wherein said braided strands have a diameter of about 7/16 inch or greater.

19. The braided rope of claim 13, wherein said rope has a circumference of about 5 inches or greater.

20. The braided rope of claim 13, wherein said rope has a circumference in the range from about 5 inches to about 20 inches.

21. The braided rope of claim 20, wherein said yarns have a twist factor in the range from about 134 to about 140.

22. The braided rope of claim 20, wherein said multiplicity of fibers are twisted together at a twist factor of about 140, said twisted yarns are braided together at a pick multiplier of about 1.35, and said braided strands are braided together at a pick multiplier of about 2.7, so that said rope is provided with a firmness suitable for towing use.

23. The braided rope of claim 20, wherein said multiplicity of fibers are twisted together at a twist factor of about 135, said twisted yarns are braided together at a pick multiplier of about 1.2, and said braided strands are braided together at a pick multiplier of about 2.4, so that said large-diameter rope is provided with a firmness suitable for mooring use.

24. A large-diameter, high-strength braided rope, comprising:

a multiplicity of low elongation fibers twisted together at a twist factor in the range from about 134 to about 140, so as to form a plurality of twisted yarns;

a plurality of said twisted yarns being braided together at a pick multiplier in the range from about 1.0 to about 1.4 so as to form a plurality of braided strands having a diameter of about 7/16 inch or greater; and a plurality of said braided strands being braided together at a pick multiplier in the range from about 2.0 to about 2.8 so as to form a rope having a circumference in the range of about 5 inches to about 20 inches.

* * * * *